US010408539B2

(12) United States Patent
Park et al.

(10) Patent No.: US 10,408,539 B2
(45) Date of Patent: Sep. 10, 2019

(54) WASHSTAND

(71) Applicant: LG ELECTRONICS INC., Seoul (KR)

(72) Inventors: Daeyun Park, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/783,233

(22) Filed: Oct. 13, 2017

(65) Prior Publication Data

US 2018/0106540 A1 Apr. 19, 2018

(30) Foreign Application Priority Data

Oct. 14, 2016 (KR) ..... 10-2016-0133442

(51) Int. Cl.

| | |
|---|---|
| ***E03C 1/04*** | (2006.01) |
| ***E03C 1/14*** | (2006.01) |
| ***E03C 1/32*** | (2006.01) |
| ***F26B 3/04*** | (2006.01) |
| ***E03C 1/186*** | (2019.01) |
| ***E03C 1/232*** | (2006.01) |
| ***F26B 21/00*** | (2006.01) |

(52) U.S. Cl.

CPC ..... *F26B 21/004* (2013.01); *E03C 1/14* (2013.01); *E03C 1/186* (2013.01); *E03C 1/232* (2013.01); *E03C 1/32* (2013.01); *F26B 3/04* (2013.01); *F26B 21/001* (2013.01); *E03C 1/04* (2013.01)

(58) Field of Classification Search

CPC ..... F26B 21/004; F26B 21/001; E03C 1/14; E03C 1/186; E03C 1/232; E03C 1/32

USPC ..... 4/630, 619

See application file for complete search history.

(56) References Cited

U.S. PATENT DOCUMENTS 9,877,620 B2 * 1/2018 Gallob ..... E03C 1/186
2015/0376881 A1 * 12/2015 Moe ..... A47K 10/48 4/638

FOREIGN PATENT DOCUMENTS

KR 20-0335250 12/2003

* cited by examiner

*Primary Examiner* — Tuan N Nguyen

(74) *Attorney, Agent, or Firm* — Ked & Associates, LLP

(57) ABSTRACT

Disclosed is a washstand including a drying module. The washstand includes a water supply valve, a washing bowl concavely formed to accommodate therein water supplied from the water supply valve and having a washstand slit formed in one side surface of an upper portion thereof, and an air-conditioning module including a fan configured to blow air toward the washing bowl through the washstand slit.

17 Claims, 6 Drawing Sheets

WASHSTAND

CROSS-REFERENCE TO RELATED APPLICATION

This application claims priority under 35 U.S.C. § 119 to Korean Application No. 10-2016-0133442, filed on Oct. 14, 2016, whose entire disclosure is hereby incorporated by reference.

BACKGROUND

1. Field

The present disclosure relates to a washstand, and more particularly, to a washstand including a module that outputs air to dry the washstand.

2. Background

After water supplied into a washing bowl (or basin) of a washstand via a water supply valve is drained, a small amount of the water may remain in the washing bowl. The water remaining in the washing bowl may dry and form a scale (or deposit), that may stain the washing bowl. Water remaining in the washstand after use may be manually removed to prevent the formation of this scale, such as wiping the remaining water in the washing bowl using, for example, a towel or a squeegee.

Korean Utility Model Registration No. KR 20-0335250 describes a bathroom that is provided with a ventilator or a ventilating opening so that the bathroom may be dehumidified via an air circulation throughout the bathroom. However, this reference does not discuss a configuration for directly removing water remaining in a washstand, and the disclosed ventilation structure may be unable to efficiently remove water remaining in a washing bowl of the washstand. The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Figure 1:
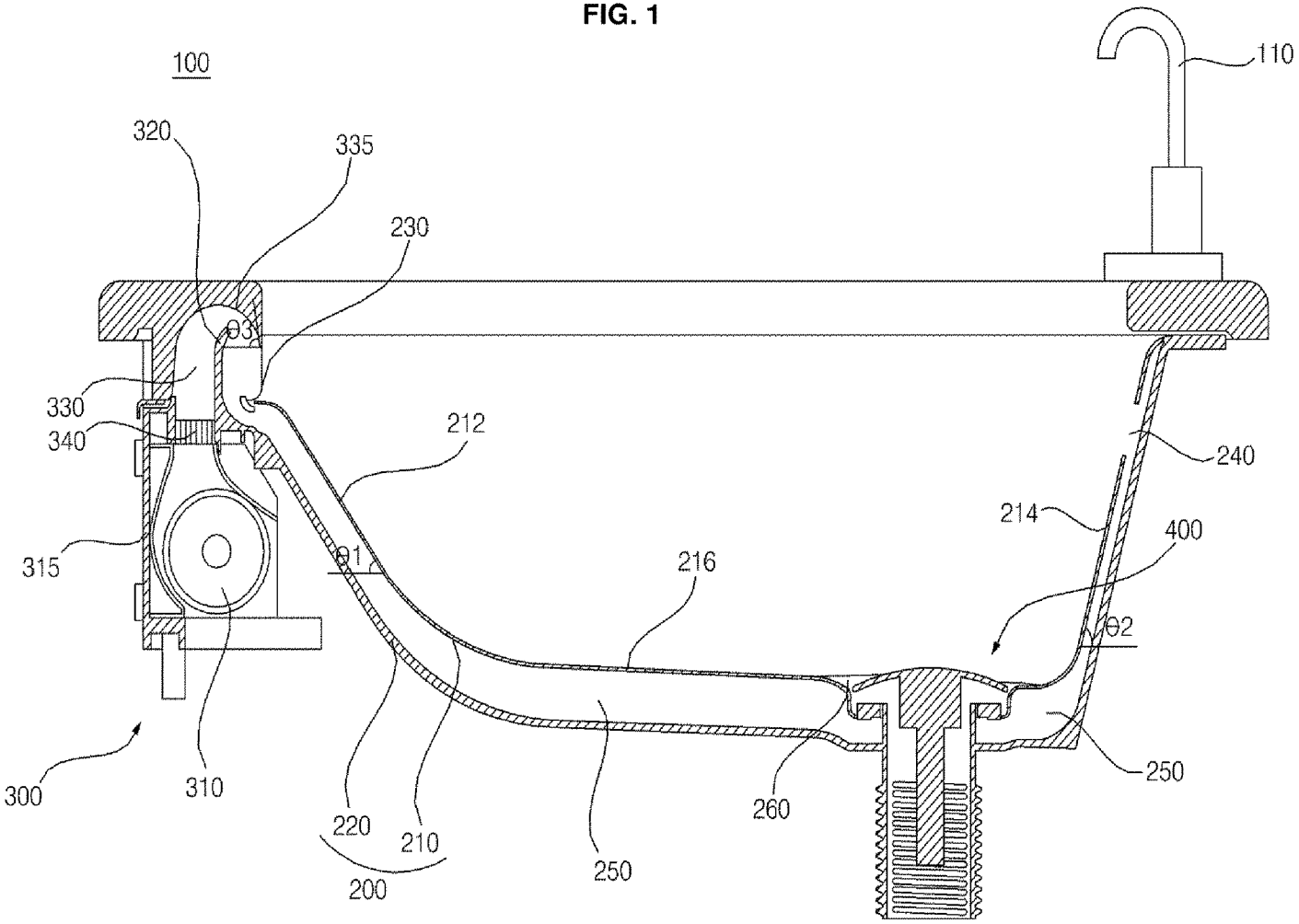
FIG. 1 is a cross-sectional view for explaining a washstand including an air-conditioning module according to an embodiment of the present disclosure.
Figure 2:
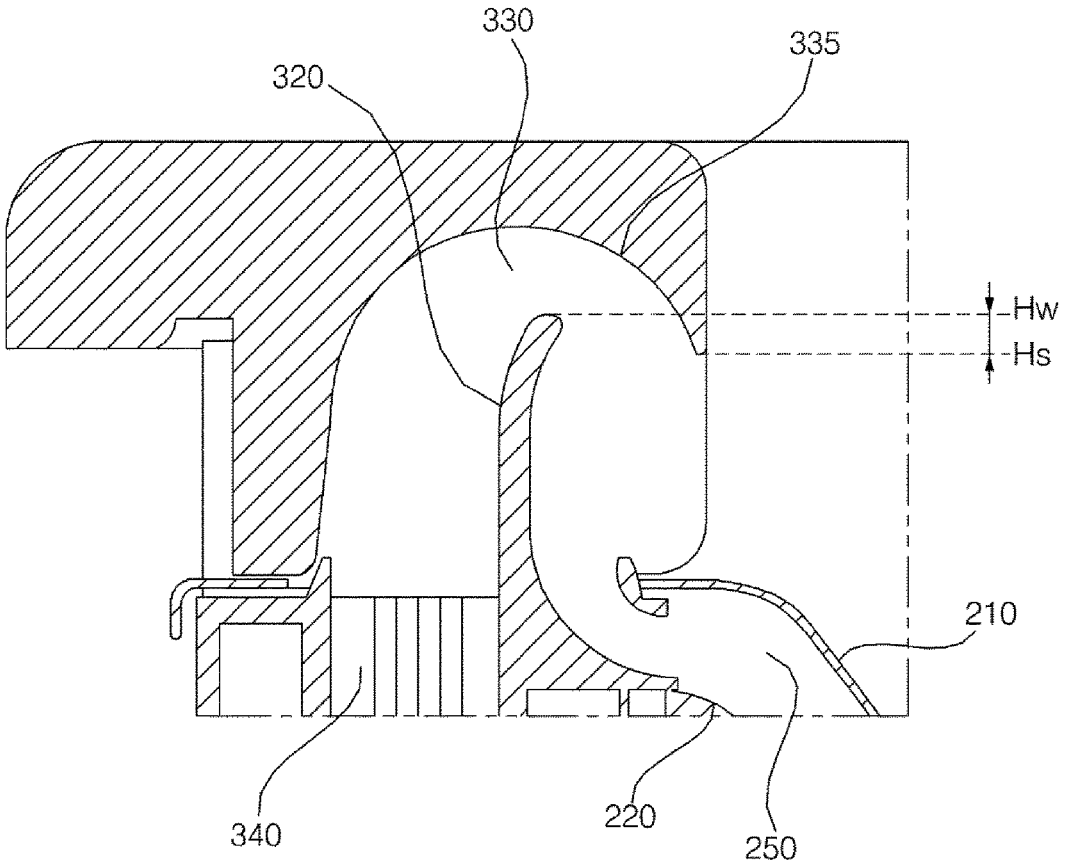
FIG. 2 is a cross-sectional view for explaining a connection flow path in the air-conditioning module according to the embodiment of the present disclosure.

Hereinafter, the present disclosure will be described with reference to the accompanying drawings to explain a washstand drying device and a washstand cabinet including the same according to embodiments of the present disclosure. Hereinafter, the washstand including an air-conditioning module according to the present embodiment will be described with reference to FIGS. 1 to 5.

The washstand 100 according to one embodiment may include a water supply valve 110, a washing bowl 200, and an air-conditioning module (or dryer) 300. The washing bowl 200 may be concavely formed to accommodate therein water supplied from the water supply valve 110 and may have a washstand slit (or outlet) 230 formed in one side surface of the upper portion thereof. The air-conditioning module 300 may include a fan 310 to blow air through the washstand slit 230.

The washstand 100 is a fixture that may be provided on a wall or other surface of a bathroom and may be configured, for example, to allow a user to wash his/her hands or face. The water supply valve 110 may be provided on an upper end or surface of the washstand 100, and the washing bowl 200 may be provided below the water supply valve 110 to accommodate water therein. The washing bowl 200 may be provided with a drain hole 260, through which water is drained. The washstand 100 may be connected to a drain facility or drain pipe (not illustrated) that receives and carries away the water introduced into the drain hole 260.

The water supply valve 110 may be provided on one region (e.g., a side of the upper rear end) of the washstand 100 to supply water into the washing bowl 200. The washing bowl 200 may use, for example, an enameled basin or an earthenware basin. In the various embodiments described herein, the washing bowl 200 may be modified into various other forms. In one implementation, the washing bowl 200 may preferably be the enameled basin because the bottom thereof may be relatively easily coupled to a housing of a washstand cabinet, which will be described below.

The washing bowl 200 according to the present embodiment may have the washstand slit 230 formed in one side surface of the upper portion thereof to discharge air toward the washing bowl 200. The washstand slit 230 may be opened to face inner surfaces 212, 214 and 216 of the washing bowl 200. For example, a top edge of the washstand slit 230 may extend horizontally over a bottom edge of the washstand slit 230 such that an opening defined by the washstand slit 230 faces downward.

Figure 3:
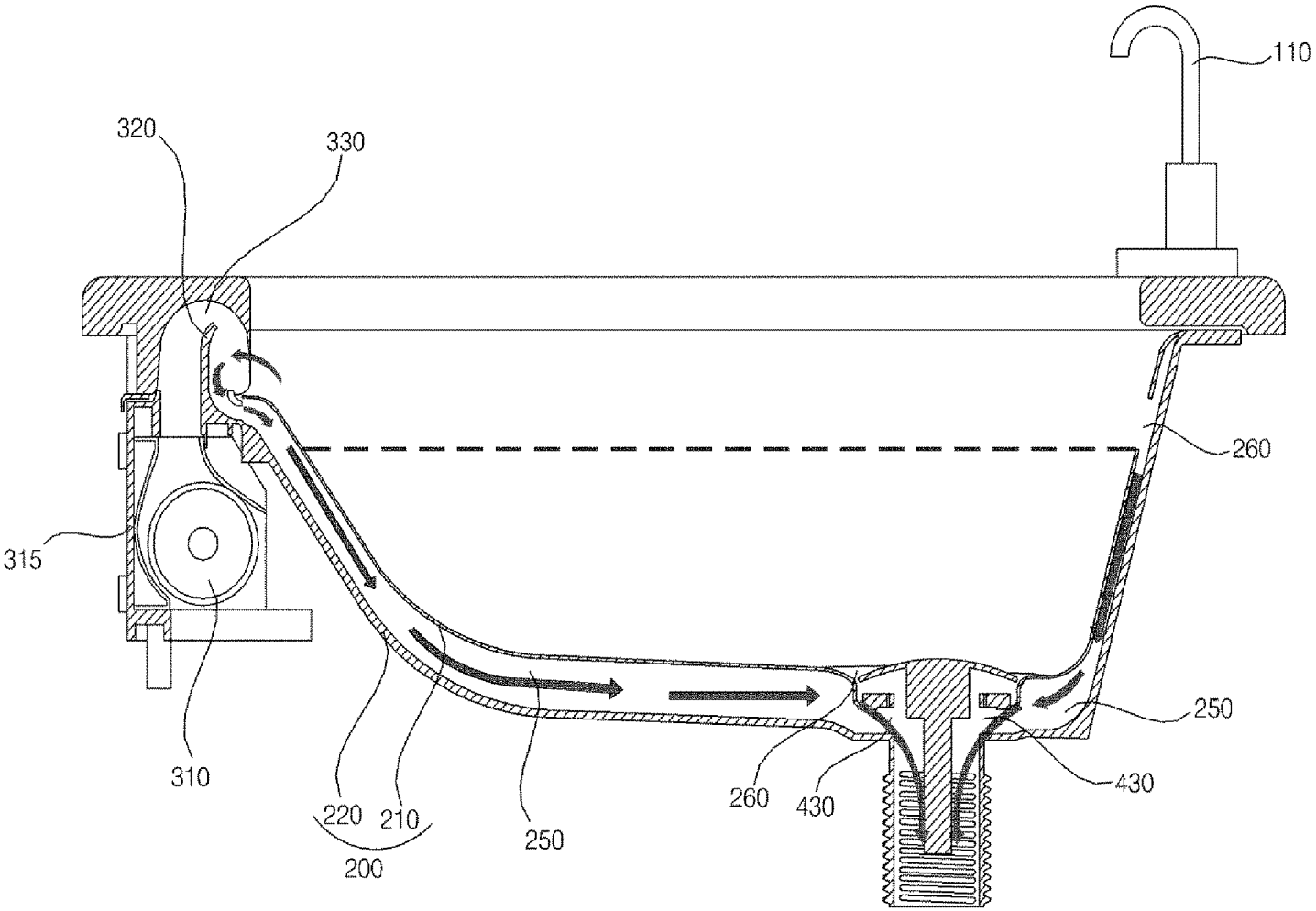
FIG. 3 is a cross-sectional view for explaining a drain flow path in the washstand including the air-conditioning module according to the embodiment of the present disclosure.

The washing bowl 200 may further include an overflow hole 240 formed in the opposite side surface thereof (e.g., opposite to the washstand slit 230) to prevent water from overflowing the washing bowl 200. Referring to FIG. 3, the overflow hole 240 may be formed at a position lower than the washstand slit 230. Because water is drained through the overflow hole 240 even if the washing bowl 200 is full of water, the overflow hole 240 may primarily prevent water from being introduced into the washstand slit 230. For example, FIG. 3 shows that an upper surface of water in the washing bowl 200, as represented by a dashed line, remains below the level of the washstand slit 230 since the water drains into the relatively lower overflow hole 240. In another example, the overflow hole 240 may be positioned at another portion of the washing bowl 200, such as adjacent to the washstand slit 230.

Hereinafter, among the directions relative to the washstand, the direction in which a user who uses the washstand is generally located, e.g., the direction in which the air-conditioning module 300 is located in the washstand 100, will be described as a front direction, and the direction in which the water supply valve is located or the direction toward the bathroom wall to which the washstand is connected will be described as a rear direction.

Referring to FIG. 1, the washing bowl 200 according to one embodiment may include a front surface portion 212, a rear surface portion 214, a bottom surface portion 216, and opposite side surface portions (not shown). The front surface portion 212 may be obliquely formed, and the air-conditioning module 300 may be located close to the front surface portion 212 and at the front of the washstand 100. The rear surface portion 214 may be obliquely formed and may be located close to the water supply valve 110. The bottom surface portion 216 may connect the front surface portion 212, the rear surface portion 214, and the opposite side surface portions.

In the washing bowl 200 of the present disclosure, the washstand slit 230 may be formed in the upper end of the front surface portion 212 and the overflow hole 240 may be formed in the rear surface portion 214. As previously described, the washstand slit 230 may be formed at a position higher than the overflow hole 240 to prevent water from entering the washstand slit 230.

The front surface portion 212 of the washing bowl 200 in which the washstand slit 230 is formed may have an inclination angle θ1, which is gentler (e.g., less steep) than an inclination angle θ2 of the rear surface portion 214. The bottom surface portion 216 may form a gentler inclined surface than the front surface portion 212. The drain hole 260 may be formed in the bottom surface portion 216 at a position close to the rear surface portion 214.

Figure 4:
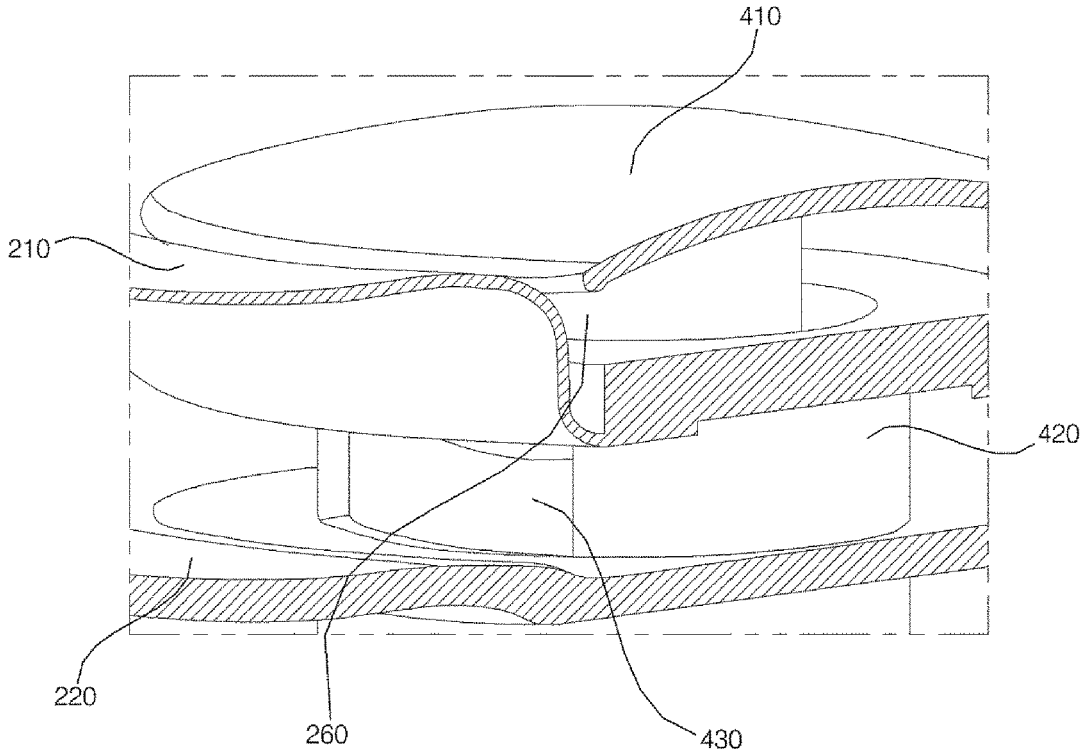
FIG. 4 is a view for explaining a pop-up valve according to the embodiment of the present disclosure.

The washing bowl 200 according to one embodiment may have a double walled structure including an upper bowl 210 in which water is accommodated and a lower bowl 220, which may be downwardly spaced apart from the upper bowl 210. A drain flow path 250 may be is formed between the upper bowl 210 and the lower bowl 220 for the drainage of water introduced into the washstand slit 230 or the overflow hole 240. Referring to FIGS. 3 and 4, water introduced into the drain flow path 250 may be discharged through an inlet hole 430 formed in a drain pipe 420. Referring to FIG. 4, at least two inlet holes 430 may be formed in different sides of the drain pipe 420.

The washstand slit 230 may be an open slit that is formed in one side surface of the washing bowl 200 so as to discharge air blown from the fan 310 of the air-conditioning module 300 toward the inner surface of the washing bowl 200. The washstand slit 230 may be formed in the front surface portion 212 of the washing bowl 200. The washstand slit 230 may further include one or more extensions or structure to direct blown air downward, toward an outer surface of the washing bowl 200. The air discharged from the washstand slit 230 may move along the front surface portion 212 and the bottom surface portion 216 of the washing bowl 200. The air discharged from the washstand slit 230 may be used to guide water remaining in the washing bowl 200 toward the drain hole 260 or to dry the water remaining in the washing bowl 200 via air convection.

Referring to FIGS. 1 and 3, the air-conditioning module 300 may include the fan 310, which blows air to the washstand slit 230. The air-conditioning module 300 may define therein a connection flow path 330 along which the air blown from the fan 310 is directed to the washstand slit 230. The air-conditioning module 300 may further include a partition (or partition extension) 320 in the connection flow path 330. The partition 320 may provide a barrier in the connection flow path 330 to prevent water from being introduced into the fan 310. The partition 320 may also function in the connection flow path 330 to guide the air blown from the fan 310 toward the washstand slit 230. The partition 320 may also function in the connection flow path 330 to guide the air blown from the fan 310 to be outputted from the washstand slit 230 in a direction toward the surfaces of the washing bowl 200.

The air-conditioning module 300 may further include a fan mount 315 on which the fan 310 is mounted and a motor that drives the fan 310. The fan mount 315 may be positioned lower than the washstand slit 230. The connection flow path 330 is may be defined in the air-conditioning module 310 so that the air blown from the fan 310 may be directed to the washstand slit 230 along the connection flow path 330. The air blown from the fan 310 may move along the connection flow path 330 to thereby be discharged from the washstand slit 230.

The connection flow path 330 is configured so that the air is discharged from the washstand slit 230 toward one or more of the front surface portion 212 or the bottom surface portion 216 of the washing bowl 200. The connection flow path 330 may be configured so that the air is discharged from the washstand slit 230 toward the upper portion of the front surface portion 212 of the washing bowl 200. The air discharged from the front surface portion 212 may move along the inclined front surface portion 212 to the bottom surface portion 216 and the rear surface portion 214.

The connection flow path 230 may form an air interconnect between the fan mount 315 and the washstand slit 230. The air-conditioning module 300 according to the present embodiment further includes a curved portion (or curved conduit) 335, which is positioned higher than the washstand slit 230 and changes the direction in which the air moves in the connection flow path 330. For example, the air blown from the fan 310, which is positioned lower than the washstand slit 230, may move along the connection flow path 330 to a position higher than the washstand slit 230 and before reaching the curved portion 335. Then, the air that has moved along the connection flow path 330 to the position higher than the washstand slit 230, i.e. the curved portion 335, may change direction in the curved portion 335 so as to be discharged to the relatively lower washstand slit 230. As such, the air moved in the connection flow path 330 may be changed in direction by the curved portion 335, to thereby be discharged downward from the washstand slit 230 and toward the inner surfaces 212, 214, and 216 of the washing bowl 200.

The end of the curved portion 335, which may be connected to the washstand slit 230, may form a slope having an inclination angle θ3, which may be equal to or steeper than the inclination angle θ1 of the inclined front surface portion 212 of the washing bowl 200. The inclination angle θ3 of the slope formed by the end of the curved portion 335 may be set to cause the air discharged from the washstand slit 230 to be directed toward the front surface portion 212 of the washing bowl 200. The inclination angle θ1 of the inclined front surface portion 212 of the washing bowl 200 may be gentler (e.g., less) than the inclination angle θ3 of the slope formed by the end of the curved portion 335.

A heater 340 may be provided in the connection flow path 330. The heater 340 may heat the air to be discharged to the washing bowl 200 so as to effectively remove water remaining in the washing bowl 200. The heater 340 may be provided in the connection flow path 330 in the front direction of the washstand 100 and on the base of the partition 320 in order to avoid being moistened by any water introduced into the washstand slit 230.

The partition 320 may be provided in the connection flow path 330 to prevent water from being introduced into the fan 310. The partition 320 may guide water introduced into the washstand slit 230 to the drain flow path 250. An upper end portion Hw of the partition 320 may be positioned higher than the upper end portion Hs of the washstand slit 230 (see FIG. 2). In one implementation, the upper end of the partition 320 may be tilted toward the washstand slit 230.

With this arrangement and shape, the partition 320 may prevent water introduced into the washstand slit 230 from being introduced into the fan 310. For example, the partition 320 extends above the upper end Hs of the washstand slit 230 to contact water introduced through the washstand slit 230, and is curved toward the washstand slit 230 such that water is directed to the drain flow path 250. Thus, the partition 320 may extend from the lower bowl 220 so as to guide water introduced into the washstand slit 230 to the drain flow path 250 (see, for example, the arrows depicted at the left side of FIG. 3). As such, the water introduced into the washstand slit 230 may move to the drain flow path 250 along the partition 320 and away from either the heater 340 or the fan 310.

Figure 5:
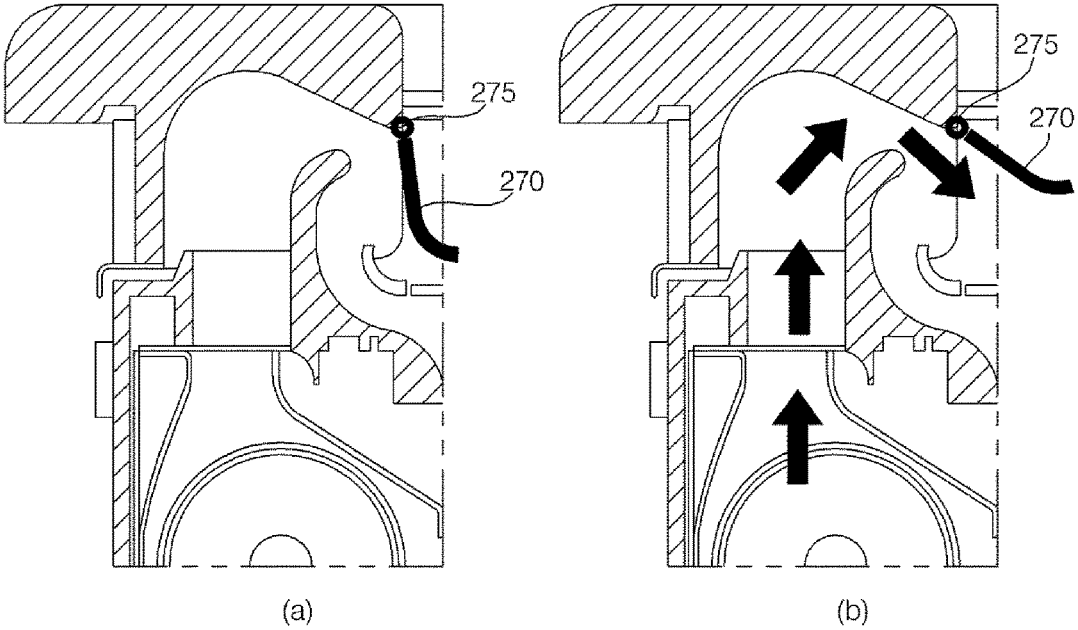
FIG. 5 shows views illustrating a portion of a washstand including a slit cover according to an embodiment of the present disclosure when a washstand slit is closed by the slit cover or is opened by the slit cover.

Referring to FIG. 5, the washstand 100 according to one embodiment may include a slit cover 270 provided to cover the washstand slit 230. The slit cover 270 may block the washstand slit 230 to prevent water into the washing bowl 200 from being introduced into the washstand slit 230. The slit cover 270 may have an upper end coupled to the upper end of the washstand slit 230 via a hinge 275 so as to rotate about the hinge 275.

When air is discharged to the washstand slit 230 via the fan 310, the slit cover 270 is rotated about the hinge 275 to open the washstand slit 230, as shown in arrows in portion (b) of FIG. 5. When no air is discharged to the washstand slit 230 via the fan 310, the slit cover 270 may close the washstand slit 230 to prevent water from being introduced into the washstand slit 230, as shown in portion (a) of FIG. 5. For example, the slit cover 270 is may rotate along the hinge 275 due to air pressure caused by an air flow by the fan 310.

The washstand 100 according to one embodiment may further include a pop-up valve 400 (or drain plug). The pop-up valve 400, when closed, may cause water to be stored in the washing bowl 200 or, when opened, may cause the stored water in the washing bowl to be drained via a drain facility 50.

Referring to FIG. 4, the pop-up valve 400 may provided in the drain hole 260 of the washing bowl 200. The pop-up valve 400 may be provided in the bottom surface portion 216 of the washing bowl 200. The pop-up valve 400 includes a drain pipe 420, which is fixedly inserted in the drain hole 260 and defines a hollow portion therein, a head 410, which is provided on the upper end of the drain pipe 420 to enable the opening or closing of the valve, and an actuator (not illustrated), which is provided to move the head 410 vertically.

As previously described, the drain pipe 420 may be provided with an inlet hole 430, through which water may be introduced into the drain flow path 250 and discharged. Water may be introduced into the drain flow path 250 through the washstand slit 230 and the overflow hole 240 is discharged through the inlet hole 430. A plurality of inlet holes 430 may be formed to discharge the introduced water to the drain pipe 420 of the pop-up valve 400 (see FIG. 3).

An input unit or user interface (not show) may be provided on a front surface of the washstand 100 and is used to input a command to a controller, which controls the operation of the fan 310 of the air-conditioning module 300. The input unit may be provided in the front direction of the washstand 100 at a position where the user can conveniently access and operate the input unit in a standing posture. For example, the input unit may be provided on the front surface or the upper surface of the air-conditioning module 300. The input unit may include, for example, one or more buttons that are actuated by a user. In another example, the input unit may include a touch screen to detect a contact by a user and may determine an input based on, for example, a location, a pattern, and/or a duration of the contact.

The input unit may be connected to the controller (not illustrated) that controls the air-conditioning module 300. The controller may be connected to the input unit and may control the air-conditioning module 300 in response to a user input command received via the input unit.

Figure 6:
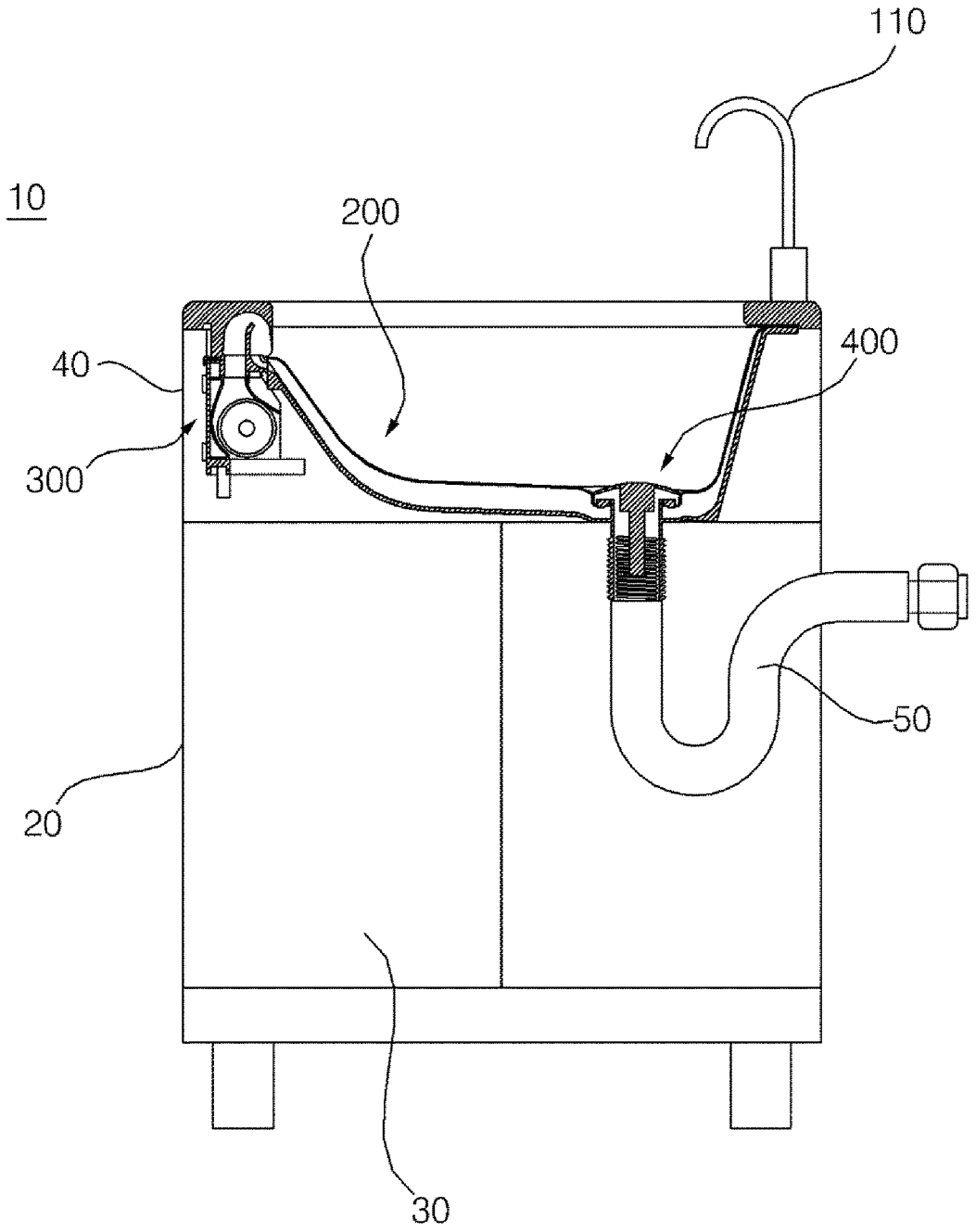
FIG. 6 is a view illustrating a washstand cabinet including an air-conditioning module according to an embodiment of the present disclosure.

FIG. 6 is a view illustrating a washstand cabinet 10 including an air-conditioning module 300 according to an embodiment of the present disclosure. Hereinafter, the cabinet on which the washstand including the air-conditioning module that dries the washstand is mounted will be described with reference to FIG. 6.

The washstand 100 according to the present embodiment may be mounted on a washstand cabinet, which provides a modular space under the washstand 100 to accommodate a module therein.

The washstand cabinet 10 according to one embodiment may include the water supply valve 110 and the washing bowl 200 that may be concavely formed to accommodate therein water supplied from the water supply valve 110 and has the washstand slit 230 formed in one side surface of the upper portion thereof. The washstand cabinet 10 may further include the air-conditioning module 300, which includes a fan to blow air toward the washing bowl 200 through the washstand slit 230, and a housing 20 that may be provided under the washing bowl 200 and may define a storage space therein.

The housing 20 may define a space 30 under the washstand 100 so that a module may be accommodated in the space 30. When no module is accommodated in the space 30 under the washstand 100, the space may be utilized as a general storage space. A module provided inside the housing 20 according to one embodiment may be an electric device used in the bathroom. For example, the module may include an electronic device to output multimedia content. The module may have a standard exterior shape and may perform various functions depending on the type thereof.

The space 30 in which a module is accommodated may be a lower space inside the washstand cabinet and may be provided under the washstand 100. Various types of modules having various functions may be mounted and used in the housing 20, depending on user preference.

The washstand 100 and the air-conditioning module 300, which moves air so as to dry the washstand 100, may be provided in an upper space of the washstand cabinet. As previously described, the washing bowl 200 of the washstand 100 may be concavely formed. Thus, the air-conditioning module 300 may be provided between the washing bowl 200 and the space 30, which is defined under the washing bowl 200 so as to accommodate a module therein.

Water may be supplied into the washing bowl 200 via the water supply valve 110 and may be discharged to a drain facility (or drain pipe) 50 through the drain hole 260 in the washing bowl 200. The housing 20 of the washstand cabinet 10 may include a space in which the drain facility 50 is accommodated.

As described above, the air-conditioning module 300 may include the fan 310, the fan mount 315 on which the fan 310 is mounted, and the connection flow path 330, which interconnects the fan 310 and the washstand slit 230 formed in the washing bowl 200 (see, FIGS. 1 and 3).

The washstand cabinet 10 may include a controller (not illustrated) that controls one or more of the air-conditioning module 300 or the module inside the cabinet 10, and an input unit 40 that may be used to input a command to the controller. The input unit 40 and the controller may be provided on the front surface of the upper portion of the housing 20 at a position at which the user may conveniently operate the input unit 40 and the controller in a standing posture.

The input unit 40 may include a button for receiving a control command related to the operation of the air-conditioning module 300 from the user. In addition, a display (not illustrated), such as, for example, a liquid crystal display (LCD) or a light emitting diode (LED) display may be provided to visually display the operating state. The input unit 40 may be formed as a touch panel to simultaneously receive a user input and to display information.

As is apparent from the above description, a washstand according to one embodiment may include a drying module that injects air into a washing bowl so as to rapidly remove water remaining in the washstand, thereby preventing the formation of scale on the washstand. In the washstand according to this embodiment, even if water is introduced into a washstand slit formed in the washing bowl, the water may be drained, rather than being introduced into a fan, through the provision of a partition and a drain flow path inside the washstand slit, or a slit cover over the washstand slit.

Thus, aspects of the present disclosure provide a washstand in which air is directly moved to a washing bowl of the washstand so as to effectively remove water remaining in the washstand. Aspects of the present disclosure further provide a washstand, which prevents water from being introduced into a washstand slit, which is formed in a washing bowl for air movement, thereby preventing water from contacting a fan. The present disclosure additionally provides a washstand cabinet in which the space under a washstand is utilized as a cabinet so that the space inside the cabinet serves as a storage space.

In accordance with one aspect of the present disclosure, a washstand including a washing bowl may be concavely formed to accommodate therein water supplied from a water supply valve and to have a washstand slit formed in one side surface of an upper portion thereof, and an air-conditioning module including a fan configured to blow air toward the washing bowl through the washstand slit. The washstand may include a partition configured to prevent water introduced into the washstand slit from moving to the air-conditioning module, or may include a slit cover provided over the washstand slit.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washstand comprising:

a water supply valve;

a washing bowl concavely formed to accommodate therein water supplied from the water supply valve and having an outlet formed on one side surface thereof;

a dryer including a fan configured to blow air toward the washing bowl through the outlet;

a connection flow path to direct the air blown by the fan to the outlet;

a drain flow path configured to discharge water introduced into the outlet; and a partition configured to guide the water introduced into the outlet to the drain flow path, wherein the connection flow path is formed so that the air discharged from the outlet is directed toward an inner surface of the washing bowl.

2. The washstand according to claim 1, wherein the outlet is opened to face the inner surface of the washing bowl.

3. The washstand according to claim 1, wherein the connection flow path is formed in an inverted U-shape.

4. The washstand according to claim 1, wherein the washing bowl further includes an overflow hole formed in a second side surface that is opposite to the one side surface, wherein the overflow hole is formed to prevent water from overflowing the washing bowl, and wherein a lower edge of the overflow hole is positioned lower than a lower edge of the outlet.

5. The washstand according to claim 1, wherein the partition prevents the water from the washing bowl from being introduced into the fan.

6. The washstand according to claim 1, wherein the partition has an upper end that is positioned higher than an upper end of the outlet.

7. The washstand according to claim 1, wherein the partition has an upper end configured to be tilted toward the outlet.

8. The washstand according to claim 1, wherein the washing bowl includes:

an upper bowl in which the supplied water is accommodated; and a lower bowl downwardly spaced apart from the upper bowl, and wherein the upper bowl and the lower bowl define therebetween the drain flow path, through which the water introduced into the outlet is discharged.

9. The washstand according to claim 8, the partition is connected to an upper end of the lower bowl so as to guide the water introduced into the outlet toward the drain flow path and away from the fan.

10. The washstand according to claim 1, further comprising a cover configured to open or close the outlet, wherein the cover has an upper end that is coupled to a hinge at an upper end of the outlet such that the cover rotates around the hinge to open the outlet when the fan is active and closes the outlet when the fan is inactive.

11. The washstand according to claim 1, wherein the dryer includes a heater to heat the air blown by the fan.

12. The washstand according to claim 1, wherein the outlet is a slit having one of a length or a width that is relatively greater than another one of the length or the width.

13. A washstand cabinet comprising:

a water supply valve;

a washing bowl concavely formed to accommodate therein water supplied from the water supply valve and having an outlet formed in one side surface of an upper portion thereof;

a fan configured to blow air toward the washing bowl through the outlet;

a housing provided under the washing bowl and configured to define a storage space therein;

a connection flow path to direct the air blown by the fan to the outlet;

a drain flow path configured to discharge water introduced into the outlet; and a partition configured to guide the water introduced into the outlet to the drain flow path, wherein the connection flow path is formed so that the air discharged from the outlet is directed toward an inner surface of the washing bowl.

14. The washstand cabinet according to claim 13, wherein the housing defines therein a space in which a module to receive an electronic component is accommodated, and wherein the fan is provided between the space in which the module is accommodated and the washing bowl.

15. The washstand cabinet according to claim 13, further comprising a heater to warm the air blown by the fan through the outlet.

16. The washstand cabinet according to claim 13, wherein the connection flow path includes a curved conduit that extends above an upper edge of the outlet.

17. The washstand cabinet according to claim 13, further comprising:

a user interface provided on the housing and configured to receive an input from a user, wherein at least one of the fan or an electronic component positioned in a space defined in the housing is controlled based on the input.

* * * * *